US006985857B2

(12) United States Patent
Adut

(10) Patent No.: US 6,985,857 B2
(45) Date of Patent: Jan. 10, 2006

(54) METHOD AND APPARATUS FOR SPEECH CODING USING TRAINING AND QUANTIZING

(75) Inventor: Victor Adut, Woodstock, IL (US)

(73) Assignee: Motorola, Inc., Schaumburg ( * ) Notice: Subject to any disclaimer, the term of this patent is extended or adjusted under 35 U.S.C. 154(b) by 634 days.

(21) Appl. No.: 09/965,400

(22) Filed: Sep. 27, 2001

(65) Prior Publication Data

US 2003/0065506 A1 Apr. 3, 2003

(51) Int. Cl.
*G10L 19/00* (2006.01)
*G10L 11/04* (2006.01)
*G10L 11/06* (2006.01)

(52) U.S. Cl. ..... 704/230; 704/207; 704/208

(58) Field of Classification Search ..... 704/205, 704/207, 208, 222, 230, 200.1
See application file for complete search history.

(56) References Cited

U.S. PATENT DOCUMENTS 4,184,049 A * 1/1980 Crochiere et al. ..... 704/229
4,969,193 A * 11/1990 Scott et al. ..... 704/216
5,097,507 A * 3/1992 Zinser et al. ..... 381/31
5,668,925 A * 9/1997 Rothweiler et al. ..... 704/220
5,699,404 A * 12/1997 Satyamurti et al. ..... 340/7.28
5,745,871 A * 4/1998 Chen ..... 704/207
5,774,837 A 6/1998 Yeldener et al.
5,960,388 A * 9/1999 Nishiguchi et al. ..... 704/208
6,047,253 A 4/2000 Nishiguchi et al.
6,078,880 A 6/2000 Zinser, Jr. et al.
6,199,040 B1 3/2001 Fette et al.
6,691,082 B1 * 2/2004 Aguilar et al. ..... 704/219
6,732,070 B1 * 5/2004 Rotola-Pukkila et al. ... 704/219
6,772,126 B1 * 8/2004 Simpson et al. ..... 704/500

OTHER PUBLICATIONS

United States Department of Defense, "Specifications for the Analog to Digital Conversion of Voice by 2,400 Bit/Second Mixed Excitation Linear Prediction," Draft Version, May 28, 1998.
Wang et al., "A 1200 bps Speech Coder based on MELP," *IEEE International Conference on Acoustics, Speech and Signal Processing*, 2000.
Kemp et al., "Multi-Frame Coding of LPC Parameters at 600-800 bps," *IEEE International Conference on Acoustics, Speech and Signal Processing*, 1997, pp. 609-612.

* cited by examiner

*Primary Examiner*—Susan McFadden
*Assistant Examiner*—Matthew J. Sked
(74) *Attorney, Agent, or Firm*—Brian M. Mancini; Randall S. Vaas

(57) ABSTRACT

A perceptually weighted speech coder system samples a speech signal and determines its pitch. The speech signal is characterized as fully voiced, partially voiced or weakly voiced. A Lloyd-Max quantizer is trained with the pitch values of those speech signals characterized as being substantially fully voiced. The quantizer quantizes the trained fully voiced pitch values and the pitch values of the non-fully voiced speech signals. The quantizer can also quantize gain values in a similar manner. Sampling is increased for fully-voice signals to improve coding accuracy. This limits application to non-real time speech storage. Mixed excitation is used to synthesize the speech signal

21 Claims, 2 Drawing Sheets

METHOD AND APPARATUS FOR SPEECH CODING USING TRAINING AND QUANTIZING

FIELD OF THE INVENTION

The present invention relates in general to a system for digitally encoding speech, and more specifically to a system for perceptually weighting speech for coding.

BACKGROUND OF THE INVENTION

Several new features recently emerging in radio communication devices, such as cellular phones, and personal digital assistants require the storage of large amounts of speech. For example, there are application areas of voice memo storage and storage of voice tags and prompts as part of the user interface in voice recognition capable handsets. Typically, recent cellular phones employ standardized speech coding techniques for voice storage purposes.

Standardized coding techniques are mainly intended for real time two-way communications, in that, they are configured to minimize buffering delays and achieving maximal robustness against transmission errors. The requirement to function in real-time imposes stringent limits on buffering delays. Clearly, for voice storage tasks, neither buffering delays nor robustness against transmission errors are of any consequence. Moreover, the timing constraints and error correction require higher data rates for improved transmission accuracy.

Although speech storage has been discussed for multimedia applications, these techniques simply propose to increase the compression ratio of an existing speech codec by adding an improved speech-noise classification algorithm exploiting the absence of coding delay constraint. However, in the storage of voice tags and prompts, which are very short in duration, pursuing such an approach is pointless. Similarly, medium-delay speech coders have been developed for joint compression of pitch values. In particular, a codebook-based pitch compression and chain coding compression of pitch parameters have been developed. However, none of these approaches exploit perceptual criteria for a given target speech quality to further improve data compression efficiency.

Therefore, there is a need for a codec with a higher compression ratio (lower data rate) than conventional speech coding techniques for use in dedicated voice storage applications. In particular, it would be an advantage to use perceptual criteria in a dedicated speech codec for storage applications. It would also be advantageous to provide these improvements without any additional hardware or cost.

BRIEF DESCRIPTION OF THE DRAWINGS

The invention is pointed out with particularity in the appended claims. However, a more complete understanding of the present invention may be derived by referring to the detailed description and claims when considered in connection with the figures, wherein like reference numbers refer to similar items throughout the figures, and:

The exemplification set out herein illustrates a preferred embodiment of the invention in one form thereof, and such exemplification is not intended to be construed as limiting in any manner.

DETAILED DESCRIPTION OF THE PREFERRED EMBODIMENTS

The present invention develops a low-bit rate speech codec for storage of voice tags and prompts. This invention presents an efficient perceptual-weighting criteria for quantization of pitch information used in modeling human speech. Whereas most prior art codecs spend around 200 bits per second for transmission of pitch values, the present invention requires only about 85 bits per second. Customary speech coders were developed for deployment in real-time two-way communications networks. The requirement to function in real-time imposes stringent limits on buffering delays. Therefore, the typical prior art speech coder operates on 15–30 ms long speech frames. Obviously, in speech storage applications coding delay is not of any consequence. Removal of this constraint enables finding more redundancies in speech, and ultimately, attaining increased compression ratios in the present invention. The improvement provided by the present invention comes at no loss in speech quality but requires increased buffering delay, and is therefore primarily suitable for use in speech storage applications. In particular, the mixed excitation linear predictive codec for speech storage tasks (MELPS) as used in the present invention operates at an average 1475 bits per second, much lower than the available prior art standard codec operating at 2400 bits per second. Subjective listening experiments confirm that the codec of the present invention meets the speech quality and intelligibility requirements of the intended voice storage application.

Figure 1:
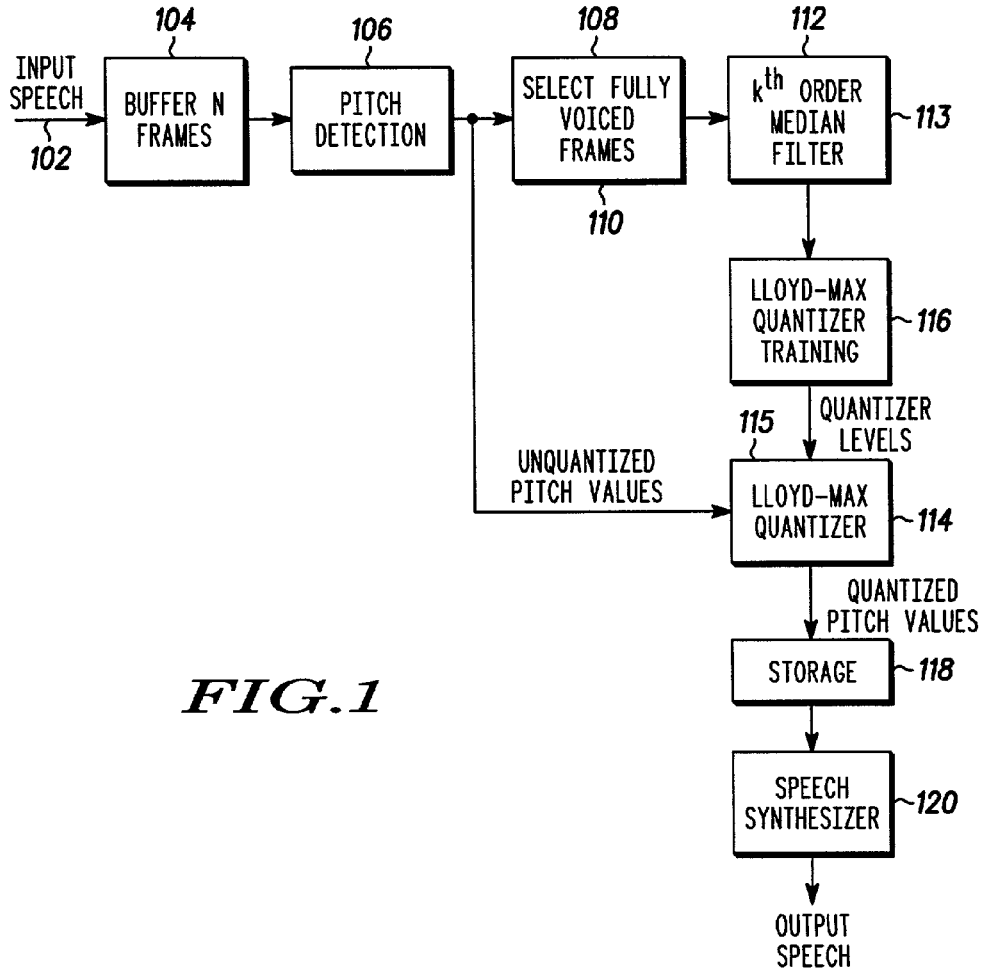
FIG. 1 shows a block diagram of a speech coder system, in accordance with the present invention.

FIG. 1 shows a perceptually weighted parametric speech coder that improves on the standard mixed-excitation linear predictive (MELP) model, in accordance with the present invention. In general, the standard MELP model belongs to the family of linear predictive vocoders that use a parametric model of human speech production. Their goal is producing perceptually intelligible speech without necessarily matching the waveform of the encoded speech. The transfer function of the human vocal tract is modeled with a linear prediction filter. Similar to the human vocal tract, this linear prediction filter is driven by an excitation signal consisting of a pitch periodic glottal pulse train mixed with noise. The mixture ratio is time varying and is determined after bandpass voicing analysis of the encoded speech waveform. For unvoiced speech, noise only excitation is used. Fully voiced speech is generated with harmonic excitation only. Partially voiced speech is synthesized with mixing low-pass noise with a pitch periodic pulse train. Preferably, an adaptive pole-zero spectral enhancer is used to boost formant frequencies. Finally, a dispersion filter is used to improve the matching of natural and synthetic speech away from formants. Several features incorporated into the improved MELPS model, in accordance with the present invention, enable the efficient storage of voice tags and prompts. These improvements come at insignificant overhead (both in terms of code space and computational complexity), and can be easily incorporated into an existing radio communication device using a MELP type coder for speech transmission.

The speech coding for storage of the present invention differs from conventional speech coding in several aspects.

The description below briefly elaborates on the factors that differentiate speech storage applications from customary speech coding tasks intended for real-time communications. Among these factors are (a) buffering delay, (b) robustness against channel errors, (c) parameter estimation, (d) speech recording conditions, (e) speech duration, and (f) reproduction of speaker identity.

Buffering delay: All standardized speech codecs are intended for deployment in two-way communications networks. Therefore, these standardized speech codec must meet stringent buffering delay requirements. However, in voice storage applications coding delay is not of any importance since real-time coding is not needed.

Robustness against channel errors: Standard cellular telephone speech codecs are required to correct for high bit error rates. Therefore, error correction bits are inserted during channel coding. Clearly, this extra information is not required in speech storage applications.

Parameter estimation: The analysis and synthesis schemes used in standard speech codecs require accurate estimation of certain parameters (such as pitch, glottal excitation, voicing information, speech-noise classification, etc.) characterizing speech signals. The requirement to operate on short buffers imposed by customary speech coding applications imply frequent errors in parameter estimation. The ability to obtain longer speech segments in the present invention clearly enable the implementation of more accurate parameter estimation schemes which imply better speech quality at a given target bit rate.

The above remarks are general in nature and apply to any speech storage application. However, additional observations can be exploited in designing a codec intended for the storage of voice tags and prompts, in accordance with the present invention.

Speech recording conditions: Standard cellular telephone speech codecs are required to operate under everyday noise environments, such as street noise and speech babble. The only known efficient way of fighting background noise is increasing the bit rate. On the other hand, stored voice prompts are recorded in controlled studio conditions, under complete absence of background noise. Similarly, voice tags are recorded during a voice recognition training phase, which is usually carried in a silent setting. This fact can be clearly exploited to achieve lower bit rates, in accordance with the present invention.

Speech duration: A number of features in standardized speech codecs are introduced to prevent certain artifacts in synthesized speech, which become noticeable only during conversational speech. Since voice tags and prompts are rather short in duration, such features need not be used in the present invention in order to further reduce the bit rate.

Reproduction of speaker identity: The majority of standard speech codecs strive to accurately model linear prediction residuals. Such precise representation is necessary only if reproduction of speaker identity is required. Although the reconstruction of speaker identity a highly desired goal in communications tasks, in the storage of voice prompts and tags, as in the present invention, it is sufficient to synthesize natural sounding speech, even though not recognizable as a particular individual Although the present invention is described the context of MELP, the above principles can be exploited in the design of any parametric and waveform codec for storage applications, in accordance with the present invention.

The present invention (MELPS) is essentially an improvement of the 2400 bps Federal Standard 1016 (FS1016) MELP, United States Dept. of Defense, "Specifications for the Analog to Digital Conversion of Voice by 2,400 Bit/Second Mixed Excitation Linear Prediction," Draft, May 28, 1998, for speech storage tasks, which is hereby incorporated by reference. The present invention enables efficient storage of voice tags and prompts at 1415 bits/second (bps) without any perceptible loss of intelligibility.

FS1016 MELP and MELPS are similar in many respects. They both process the input speech in 22.5 ms frames sampled at 8 kHz and quantized to 16 bits per sample. Both use different frame formats for unvoiced and voiced speech. Due to the similarities between these codecs, the discussion below shall be based only on the distinctions between FS1016 MELP and MELPS. Such a presentation helps to emphasize the application of the principles of the present invention.

FS1016 MELP models the human vocal tract based on the following features: linear predictive coefficients and spectral frequencies, pitch, bandpass voicing strengths, gain, Fourier magnitudes, aperiodic excitation flag, and error correction information. MELPS incorporates only the linear predictive modeling used in FS1016 MELPS without any changes; all other attributes have been altered in order to achieve reduced bit-rate for speech storage tasks. Some of these modifications exploit perceptual criteria, and some of them rely on block quantization schemes, which are inspired by the removal of buffering delay constraints. The improvements are outlined below.

FS1016 MELP uses seven bits per frame for encoding of pitch values. However, the removal of buffering delay constraints is storage applications enables the present invention to reduce the number of bits used for encoding of pitch information about 65%. The improvement provided by the present invention is motivated by the following three observations.

Firstly, for short speech segments (one to two seconds), the pitch of voiced frames do not show a significant deviation from the mean.

Secondly, from a perceptual point of view, it is desirable to quantize the pitch of fully voiced speech segments (that is, vowel sounds such as /o/, /u/, etc.) with minimal error. On the other hand, pitch quantization errors on partially voiced speech regions (that is, voiced fricatives such as /v/, /z/, etc.) are not as noticeable, and therefore a higher quantization error margin can be tolerated.

Thirdly, pitch detection algorithms make frequent pitch doubling errors. The absence of buffering delay constraint in speech storage tasks opens up the possibility of eliminating incorrect pitch values by simply using a median filter.

Thus, the present invention includes the following method and apparatus for coding speech with perceptual weighting using block quantization of pitch values, as represented in FIG. 1. Note that the description below requires at least a sampling rate of 8 kHz. If a higher sampling rate is used, frequencies above 4 kHz are not required. A first step includes sampling 102 a speech signal and storing the sample in a buffer 104. The buffer 104 can store multiple (N) frames to be jointly quantized as a unit (block). This includes dividing input speech into multiple frames, such as those containing one or two seconds of speech for example, and buffering N such frames to be block quantized in subsequent steps. A next step includes a pitch detector 106 coupled to the buffer 104 to determine a pitch of the speech signal of the buffered frames. Preferably, this is done on a logarithmic scale as is done in the standard coder model. To this end, any suitable pitch detection algorithm can be used in the pitch detector, as are known in the art.

A next step includes characterizing 108 the voiced quality of the speech signal in a voice analyzer 110 coupled to the pitch detector 106 to determine whether the speech signal in the buffered frames is substantially fully voiced or whether it is partially or weakly voiced. In particular, for characterizing each voiced frame, the input speech is divided into a plurality of frequency spectrum bands. The voiced quality of the speech signal in each spectrum band is established using techniques known in the art, and if a majority of the plurality spectrum bands are established to be of a speech signal of a voiced quality, then the speech signal is characterized as being substantially fully voiced. For example, the input speech is divided into five bands spanning the ranges 0–500 Hz, 500–1000 Hz, 1000–2000 Hz, 2000–3000 Hz, and 3000–4000 Hz. A separate voiced/unvoiced decision is made for each band, as is known in the art. If three or more bands are voiced, the input speech is declared as substantially fully voiced. Otherwise, the input speech is declared as partially or weakly voiced.

The pitch values of fully voiced frames are copied sequentially into an array, which is then passed through a $k^{th}$ order median filter 112 coupled between the voice analyzer 110 and a quantizer 114. The median filtering 113 removes the effects of pitch doubling errors, which is common in pitch detection. Afterwards, the fully voiced pitch values are used in the training 116 of an $m^{th}$ order Lloyd-Max quantizer, as is known in the art. Finally, the method includes block quantizing 115 the Lloyd-Max quantizer pitch values from the training step 116 and the pitch values of those speech signals from the pitch detector 106 characterized as not being substantially fully voiced. Thus, the present invention provides efficient block quantization of pitch values. The quantized pitch values, along with other coded speech parameters, are then stored in a memory 118 for later decoding, synthesis and playback.

In practice, the method of the present invention operates on blocks of fifty frames. First, the bandpass voicing and pitch decisions for each frame in the block are computed, using algorithms similar to those of FS1016 MELP. Frames with at least three voiced bands are declared as strongly voiced, with one bit assigned for the voicing decision. Frames with fewer bandpass voicing bits set are classified as partially or weakly voiced. The pitch values from the strongly voiced frames are sequentially copied into an array. In order to eliminate the effects of pitch doubling errors, this array is passed trough a 5th order median filter. The resulting pitch values are used in the training of a 4th order Lloyd-Max quantizer. Finally, the pitch values of the voiced frames in the block are quantized with the Lloyd-Max quantizer.

FS1016 MELP uses seven bits per voiced frame to represent pitch information. Pitch information is required only for encoding of voiced speech. Experimental observations show that in the average two thirds of human speech is voiced. Thus, given that FS 1016 MELP uses 22.5 ms long frames, the number of voiced frames per second can be computed as the number of frames per second times the percentage of voiced frames or:

$$(1000/22.5)*(2/3)=29.63 \text{ frames/sec.}$$

Hence, to represent the pitch information using seven bits per voiced frame, FS 1016 MELP uses $$29.63*7=207.41 \text{ bits/sec.}$$

In the present invention, the compression ratio achieved by the improved pitch quantization conveys the pitch information in two parts, namely, coefficients of a quantizer and quantized pitch values. A 4th order Lloyd-Max quantizer is used that represents each level using seven bits. The parameters of the Lloyd-Max quantizer can be encoded with twenty-eight bits (i.e. seven bits per four levels). The quantizer is updated every fifty frames. The bit rate of the block quantizer coefficients (quantization overhead) can be computed as the number of quantizer coefficients times the frequency of coefficient updates or:

$$(4*7)*[1000/(50*22.5)]=24.89 \text{ bits/sec.}$$

Since a fourth order block quantizer is used, number of quantized pitch bits per voiced frame is given as $$\log 2(\text{quantizer levels})=\log 2(4)=2 \text{ bits}$$

so that only two bits per pitch value is required instead of the seven bits for the FS1016 MELP codec. Thus, bit rate of quantized pitch bits is the number of voiced frames per second times the number of quantized pitch bits per frame or:

$$29.63*2=59.26 \text{ bits/sec.}$$

Thus, pitch can be represented using only the block quantization overhead per second plus the block quantized pitch bits per sec or:

$$24.88+59.26=84.15 \text{ bits/sec}$$

which is much less than the 207.41 bits/second used in the FS1016 MELP codec.

Figure 2:
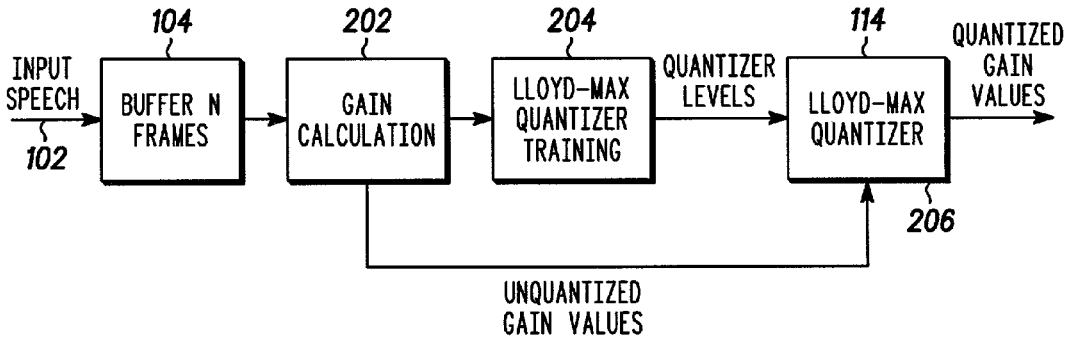
FIG. 2 shows a block diagram of block pitch quantization, in accordance with the present invention.

Preferably, the present invention includes block quantization of gain information in a gain detector similar to the handling of pitch information described above, and as represented in FIG. 2. In particular, the sampling 102 and buffering 104 steps are the same, but the determining step of the method includes determining 202 a gain of the speech signal, the training step 204 includes training a Lloyd-Max quantizer 114 with the gain values of those speech signals from the determining step 202 characterized as being substantially fully voiced, and the quantizing step includes quantizing 206 the gain values from the training step 204 and the gain values of those speech signals from the determining step 202 not characterized as being substantially fully voiced in characterization.

For example, FS1016 MELP uses eight bits per frame for encoding of gain information. However, MELPS uses a more efficient block quantization scheme for storage of gain coefficients, which resembles the pitch quantization scheme described above. Input speech is grouped into blocks comprised of fifty frames. Similar to the quantization of pitch values, gain information is divided into two parts: coefficients of a block quantizer and quantized gain values. The quantizer coefficients span the range 10–77 dB, and listening experiments indicated that ten bits are sufficient for their accurate quantization. The gain values from these frames are used to train an eight-level Lloyd-Max quantizer, which is updated every fifty frames. Ten bits are used to represent each level. Thus, the bit rate of the block quantizer (quantization overhead) is given by the number of quantizer coefficients times the frequency of coefficient updates or $$(8*10)*[1000/(50*22.5)]=71.11 \text{ bits/second}$$

which is about 1.6 bits/frame. Since an eighth order (level) block quantizer is used, the quantized gain values can be represented using $$\log 2(\text{quantizer levels})=\log 2(8)=3 \text{ bits}$$

Thus, each gain value can be encoded with as little as three bits per frame in the present invention. The bit rate of quantized gain values is the number of frames per second times the number of quantized gain bits per frame or:

$$(1000/22.5)*3=133.33 \text{ bits/sec.}$$

Thus, MELPS represents gain using the block quantization overhead per second plus the block quantized gain bits per second or $$71.11+133.33=204.44 \text{ bits/sec.}$$

Hence, the number of bits spent for representation of gain information is reduced from 8 bits per frame in the prior art to about 4.6 bits per frame (1.6+3) in the present invention.

Figure 3:
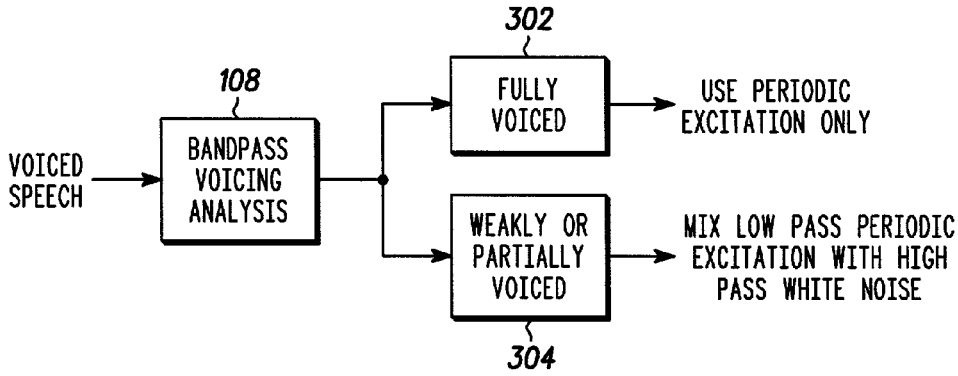
FIG. 3 shows a block diagram of perceptual weighting of voicing analysis, in accordance with the present invention.

The FS1016 MELP codec divides the speech spectrum into five bands and makes separate voiced/unvoiced decisions in each band. These decisions are exploited in adjusting the pulse-noise mixture for the linear predictive excitation signal. However, the absence of background noise during voice prompt and voice tag recording opens up the possibility of a simpler mixed excitation model for the present invention, as shown in FIG. 3. As done in the pitch compression technique previously described, each frame or bandpass within a frame is voice analyzed 108 and classified as either partially or weakly voiced 304 (e.g., voiced consonants) or fully voiced 302 (e.g., vowel sounds). Fully voiced phonemes of speech are then synthesized, in a speech synthesizer coupled to the quantizer (see 120 and 114 of FIG. 1), with a pitch periodic excitation train only. Weakly or partially voiced phonemes are then synthesized with a low-pass filtered pitch periodic excitation signal mixed with high-pass white noise. As a result, the number of bits spend on bandpass voicing information is reduced from four bits per voiced frame in the prior art to one bit per voiced frame in the present invention.

Figure 4:
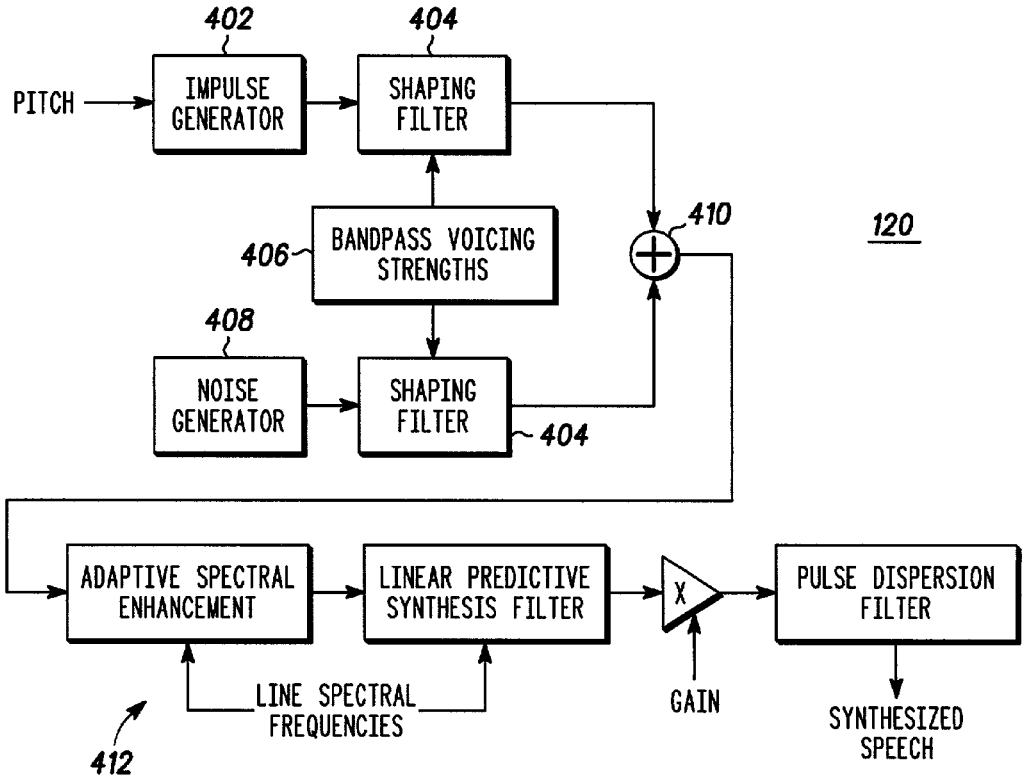
FIG. 4 shows a block diagram of gain quantization, in accordance with the present invention.

Advantageously, other parameters used in standard codecs can also be mostly ignored in those application for stored speech, such as used in the present invention. FIG. 4 demonstrates the usage of the stored speech parameters in speech synthesis. For example, standard codecs use Fourier magnitude modeling to achieve better synthesis of nasal phonemes, improved reproduction of speaker identity, and increased noise robustness. As confirmed by informal listening experiments, the impact of using an excitation signal derived from Fourier magnitudes is quite subtle. In fact, it is barely noticeable over the relatively short duration of a voice prompt or tag, as is used in the present invention. Therefore, Fourier magnitude modeling is not used in the present invention without having any perceptible effect on speech quality. Instead of relying on Fourier magnitude modeling, following the approach taken in LPC-10 codecs, the present invention (MELPS) uses an pitch excitation signal and impulse generator 402 with flat spectral response in the shaping filters 404. This is equivalent to setting all Fourier magnitude coefficients in FS1016 MELP to $10^{-1/2}$.

Another parameter to ignore is the aperiodic flag. The purpose of jittery voicing, signaled by the aperiodic flag, is to model the erratic glottal pulses encountered in voicing transitions. Although jittery voicing has a notable perceptual effect when FS1016 MELP is employed to encode conversational speech, its absence does not cause any degradation in speech quality when working on short speech segments. Therefore, this feature of FS1016 MELP is not used in the present invention saving data bits. Another parameter to ignore is coded error correction information. Obviously, for the storage of voice tags, there is no point in including the error correction information computed by FS1016 MELP, saving further bits.

The bandpass voicing strengths 406, characterized as being voiced or unvoiced so are driven by the pitch excitation of noise 408, as previously referenced with respect to FIG. 3. The voiced and unvoiced excitations are then summed 410 and processed through the linear prediction process 412 similar to that of the standard FS1016 MELP.

EXAMPLE 1

The bit allocation and frame format of MELPS is shown in Table 1.

TABLE 1

MELPS bit allocation.

| Parameters | Bits per voiced frame | Bits per unvoiced frame | Average block quantization overhead per frame in bits |
|---|---|---|---|
| Voiced/Unvoiced Decision | 1 | 1 | — |
| Gain | 3 | 3 | 1.6 |
| LPC Coefficients | 25 | 25 | — |
| Pitch | 2 | — | 0.56 |
| Bandpass Voicing | 1 | — | — |
| Bits per 22.5 ms frame | 32 | 29 | 2.16 |

Each unvoiced frame consumes 31.16 bits whereas each voiced frame uses 33.16. In addition, there are 108 quantizer coefficients (28 pitch quantizer levels and 80 gain quantizer levels) of overhead. Every 22.5 milliseconds, the coder decides whether the input speech is voiced or not. If the input speech is voiced, a voiced frame with the format shown in the first column of Table 1 is output. The first bit of a voiced frame is always set. If the input speech is unvoiced, an unvoiced frame with the format shown in the second column of Table 1 is output is output. The first bit of an unvoiced frame is always reset. The quantizer coefficients frame is produced every 1125 ms. Assuming that two thirds of human speech is voiced (two voiced frames for every one unvoiced frame), the average bit rate of the present invention is $$\text{voiced frame size} * \text{average number of voiced frames per sec.} + \text{unvoiced frame size} * \text{average number of unvoiced frames per sec.} + \text{block quantization overhead per sec.} = 32*29.63+29*29.63/2+108/1.125 \approx 1475 \text{ bits per sec.}$$

This represents approximately 40% reduction in bit rate compared with FS 1016 MELP.

EXAMPLE 2

The above technique was incorporated into the improved MELPS model, in accordance with the present invention. The implementation relied on the same pitch detection and voicing determination algorithms used in this government standard speech coder, FS1016 MELP. The coefficient values are shown in Table 2. For the below parameters, an average of 4.44 bits per voiced frame is saved in the present invention over that of the standard FS1016 MELP codec.

TABLE 2

Coefficient values used in block pitch quantizer implementation.

| | |
|---|---|
| Unquantized Pitch Values (bits) | 7 |
| Frame Length /(ms) | 22.5 |
| SuperBlock Size N (frames) | 50 |
| Median Filter Order k | 5 |
| Lloyd-Max Quantizer Order m | 4 |

In order to assess the speech quality impact of the improved codec of the present invention, an A/B (pairwise) listening test with eight sentence pairs uttered by two male and two female speakers was performed. The reference codec was FS1016 MELP. For 75% of sentence pairs, the listeners were unable to tell the difference between FS1016 MELP and the code of the present invention (MELPS). For 15% of sentence pairs, the listeners preferred FS1016 MELP, and for the remaining 10%, the MELPS codec of the present invention with improved pitch compression algorithm was preferred. In a second A/B (pairwise) listening test, four listeners compared the output of MELPS with MELP. The tests were done using 32 voice tags spoken by one male and one female speaker were used. The subjects found little difference between MELPS and MELP. In accordance with these results, the quality of MELPS is judged to be sufficient for a voice storage applications.

In summary, the present invention provides several improvements over prior art codecs. The present invention provides a set of guidelines, which can be used for adopting most standardized speech coders to speech storage applications. A new approach to pitch quantization is also provided. The present invention utilizes block encoding of pitch and gain parameters, and provides a simplified method of mixed excitation generation that is based on a new interpretation of bandpass voicing analysis results. The present invention exploits the relative perceptual impact of individual pitch values in providing a speech compression technique not addressed in a speech coder before. As supported by the listening experiments described above, the present invention can be used to attain increased compression ratios without adversely affecting speech quality.

Although the invention has been described and illustrated in the above description and drawings, it is understood that this description is by way of example only and that numerous changes and modifications can me made by those skilled in the art without departing from the broad scope of the invention. Although the present invention finds particular use in portable cellular radiotelephones, the invention could be applied to any multi-mode wireless communication device, including pagers, electronic organizers, and computers. Applicants' invention should be limited only by the following claims.

What is claimed is:

1. A method of coding speech signals using perceptual weighting, the method comprising the steps of:

sampling a speech signal;

determining at least one pitch value of the sampled speech signal;

characterizing the voiced quality of the sampled speech signal;

training a Lloyd-Max quantizer with pitch values of those speech signals characterized as being substantially fully voiced in the characterizing step and not training the quantizer with at least some of the speech signals characterized as being partially voiced in the characterizing step; and quantizing the pitch values of at least the speech signals characterized in the characterizing step as being substantially fully voiced and the speech signals characterized in the characterizing step as being partially voiced.

2. The method of claim 1, wherein before the training step further comprising a step of median filtering the pitch values of those speech signals characterized as being substantially fuily voiced in the characterizing step, thereby removing pitch doubling errors.

3. The method of claim 1, wherein the characterizing step includes the substeps of:

dividing the sampled speech signal into a plurality of frequency spectrum bands, establishing the voiced quality of the sampled speech signal in each spectrum band, and describing the sampled speech signal as being substantially fully voiced if a majority of the plurality spectrum bands are established to be of a speech signal of a voiced quality.

4. The method of claim 3, wherein the dividing step includes five spectrum bands.

5. The method of claim 1, wherein the speech signal of the sampling step does not use error correction.

6. The method of claim 1, wherein after the sampling step further comprising the step of buffering the speech signal for a multiple of frames to be block quantized in subsequent steps, wherein the number of buffered frames of speech is increased during periods of substantially voiced speech to enable more accurate coding during the subsequent steps.

7. The method of claim 1, further comprising the step of storing the quantized pitch values in a memory for later decoding, synthesis and playback.

8. The method of claim 1, wherein the quantizing step quantizes using two bits per pitch value.

9. The method of claim 1, wherein the determining step includes determining a gain of the sampled speech signal, the training step includes training a Lloyd-Max quantizer with the gain values of those speech signals from the determining step characterized as being substantially fully voiced in the characterizing step, and the quantizing step includes quantizing the gain values from the training step and the gain values of those speech signals from the determining step not characterized as being substantially fully voiced in the characterizing step.

10. The method of claim 1, further comprising the step of synthesizing speech, wherein a substantially fully voiced speech signal is synthesized using a pitch periodic excitation train and a speech signal that is not substantially fully voiced is synthesized using a lowpass filtered pitch periodic excitation signal mixed with highpass white noise.

11. The method of claim 10, wherein the synthesizing step includes using pitch periodic excitation trains with substantially flat spectral response.

12. A method of coding speech using perceptual weighting, the method comprising the steps of:

sampling a speech signal;

buffering the speech signal for a multiple of frames to be block quantized in subsequent steps, wherein the number of frames of speech being buffered is increased during periods of substantially voiced speech as determined in the subsequent steps;

determining at least one pitch of the speech signal;

characterizing the voiced quality of the speech signal;

training a Lloyd-Max quantizer with the pitch values from the determining step of only those speech signals characterized as being substantially fully voiced in the characterizing step;

quantizing the pitch values at least those speech signals characterized as being substantially fully voiced in the characterizing step and those speech signals characterized as being partially voices in the characterizing step; and synthesizing speech, wherein a substantially fully voiced speech signal is synthesized using a pitch periodic excitation train and a speech signal that is not substantially fully voiced is synthesized using a lowpass filtered pitch periodic excitation signal mixed with highpass white noise.

13. The method of claim 12, wherein the determining step include determining a gain of the speech signal, the training step includes training a Lloyd-Max quantizer with the gain values of those speech signals from the determining step characterized as being substantially fully voiced in the characterizing step, and the quantizing step includes quantizing the gain values from the training step and the gain values of those speech signals from the determining step not characterized as being substantially fully voiced in the characterizing step.

14. The method of claim 12, wherein the sampling step is performed at a variable sampling rate wherein the sampling rate is increased during periods of substantially voiced speech and decreased during other periods.

15. An apparatus for coding speech using perceptual weighting, the apparatus comprising:

a buffer, the buffer inputs a speech signal and stores samples thereof;

a pitch detector coupled to the buffer, the pitch detector determines a pitch of the speech signal;

a voicing analyzer coupled to the pitch detector, the voicing analyzer characterizes the speech signal as to whether it is substantially fully voiced or not substantially fully voiced and a Lloyd-Max quantizer coupled to the voicing analyzer and pitch detector, the quantizer is trained with and quantizes the pitch values of those speech signals from the voicing analyzer characterized as being substantially fully voiced, the quantizer also quantizes, but is not trained with, at least some of the pitch values of those speech signals from the pitch detector not characterized as being substantially fully voiced.

16. The apparatus of claim 15, further comprising a median filter coupled between the voicing analyzer and quantizer, the median filter filters the pitch values from the voicing analyzer to remove pitch-doubling errors.

17. The apparatus of claim 15, wherein the buffer buffers a multiple of frames to be block quantized in the quantizer and increases the number of buffered frames of speech during periods of substantially voiced speech to enable more accurate coding.

18. The apparatus of claim 15, further comprising a gain detector coupled between the buffer and quantizer, wherein the quantizer is trained with and quantizes gain values of those speech signals from the voicing analyzer characterized as being substantially fully voiced, the quantizer also quantizes the gain values of those speech signals from the gain detector not characterized as being substantially fully voiced.

19. The apparatus of claim 15, further comprising a speech synthesizer coupled to the quantizer, wherein a substantially fully voiced speech signal is synthesized using a pitch periodic excitation train and a speech signal that is not substantially fully voiced is synthesized using a lowpass filtered pitch periodic excitation signal mixed with highpass white noise.

20. The apparatus of claim 19, wherein the speech synthesizer includes using pitch periodic excitation trains with substantially flat spectral response.

21. The apparatus of claim 15, wherein the voice analyzer is operable to characterize at least substantially fully voiced, partially voiced, and weekly voiced speech.

* * * * *